US011213104B1

(12) United States Patent
Ou

(10) Patent No.: US 11,213,104 B1
(45) Date of Patent: Jan. 4, 2022

(54) DETACHABLE COSMETIC BAG

(71) Applicant: XIAMEN XINWEIFA ELECTRONIC COMMERCE CO., LTD., Xiamen (CN)

(72) Inventor: Aimei Ou, Xiamen (CN)

(73) Assignee: XIAMEN XINWEIFA ELECTRONIC COMMERCE CO., LTD., Xiamen (CN)

( * ) Notice: Subject to any disclaimer, the term of this patent is extended or adjusted under 35 U.S.C. 154(b) by 0 days.

(21) Appl. No.: 17/369,904

(22) Filed: Jul. 7, 2021

(30) Foreign Application Priority Data

May 31, 2021 (CN) ..... 202110597690.3

(51) Int. Cl.
*A45C 7/00* (2006.01)
*A45C 13/02* (2006.01)
*A45C 5/00* (2006.01)

(52) U.S. Cl.
CPC ..... *A45C 7/0045* (2013.01); *A45C 5/005* (2013.01); *A45C 13/02* (2013.01)

(58) Field of Classification Search
CPC ..... A45C 7/0045; A45C 5/005; A45C 13/02
See application file for complete search history.

(56) References Cited

U.S. PATENT DOCUMENTS 1,711,030 A * 4/1929 Pifer ..... A47F 5/005 312/140
2,010,471 A * 8/1935 Ygberg ..... B65D 25/06 217/7
2,181,587 A * 11/1939 Plotkin ..... A45C 13/02 190/109
3,381,782 A * 5/1968 Geralds ..... A45C 13/02 206/593
3,957,141 A * 5/1976 Domes ..... A45C 13/40 190/102
4,258,856 A * 3/1981 Marling ..... A47B 88/90 220/552
4,804,943 A * 2/1989 Soleimani ..... A45C 13/24 190/101
D300,987 S * 5/1989 Gerch ..... D3/284
5,996,749 A * 12/1999 Hillsberg ..... G06F 1/1628 190/109
6,073,794 A * 6/2000 Bidot ..... A47B 88/975 220/529
6,296,094 B1 * 10/2001 Knecht ..... A45C 7/0095 190/107

(Continued)

*Primary Examiner* — Tri M Mai

(57) ABSTRACT

The present disclosure provides a detachable cosmetic bag including a cosmetic bag main body; a plurality of inner supporting plates respectively arranged on inner sidewalls of the cosmetic bag main body; and a plurality of partition plates. Each partition plate is formed by a plurality of connecting portions and a plurality of protruding portions, a plurality of strip grooves are formed on two sides of each partition plate, two ends of each partition plate are connecting portions to enable the partition plate to be connected with the supporting grooves on the inner supporting plates and/or the strip grooves on two sides of other partition plates. The cosmetic bag provided by the present disclosure is multi-functional with an inner space that can be freely changed in combination. The lower-layer bag body is foldable, improving user experience and making it easy to carry.

8 Claims, 10 Drawing Sheets

(56) References Cited

U.S. PATENT DOCUMENTS

| | | | | |
|---|---|---|---|---|
| 2012/0205335 | A1* | 8/2012 | Abdullahi | A47B 88/90<br>211/184 |
| 2012/0205415 | A1* | 8/2012 | Abdullahi | B60P 7/0892<br>224/539 |

* cited by examiner

DETACHABLE COSMETIC BAG

CROSS-REFERENCE TO RELATED APPLICATIONS

This application is based upon and claims priority to Chinese Patent Application No. 202110597690.3, filed on May 31, 2021, the entire contents of which are incorporated herein by reference.

TECHNICAL FIELD

The present disclosure relates to the field of cosmetic-related products, and more particularly to a detachable cosmetic bag.

BACKGROUND

Cosmetic bags, which are packages for holding and carrying cosmetic products, are necessities for both professional makeup artists and individuals who love making up themselves/others. There are a wide variety of cosmetic products, and most of the cosmetic products are costly. Hence, a dedicated cosmetic bag is often used to store and organize the cosmetic products, for either indoors or outdoors use, so as to protect the cosmetic products and make them easy to carry.

According to the functions, cosmetic bags can be classified into three categories: professional cosmetic bags, cosmetic bags for home use, and travel cosmetic bags. Cosmetic bags, having different divisions of functional modules, are used in different scenarios. The existing cosmetic bags tend to have increasing functions. However, the more functions the cosmetic bag has, the larger volume it has. A large volume makes the cosmetic bags bulky and inconvenient to carry. Therefore, it is desirable to design a cosmetic bag with multiple functions without increasing its volume.

SUMMARY OF THE DISCLOSURE

The present disclosure provides a detachable cosmetic bag, which can effectively solve the above problems.

The present disclosure is realized by the following technical solution.

A detachable cosmetic bag includes a cosmetic bag main body; a plurality of inner supporting plates, wherein the inner supporting plates are respectively arranged on inner sidewalls of the cosmetic bag main body, a side surface of each inner supporting plate is provided with supporting grooves arranged uniformly; and a plurality of partition plates, wherein each partition plate is formed by sequentially connecting a plurality of connecting portions and a plurality of protruding portions, a size of each connecting portion is smaller than a size of each protruding portion to form a plurality of strip grooves on two sides of each partition plate, two ends of each partition plate are connecting portions to enable the partition plate to be connected with the supporting grooves on the inner supporting plates and/or the strip grooves on two sides of other partition plates.

As a further improvement, the cosmetic bag main body includes an upper-layer bag body and a lower-layer bag body; the inner supporting plates and the partition plates are both arranged inside the lower-layer bag body.

As a further improvement, the lower-layer bag body includes a first sidewall, a second sidewall, a third sidewall, and a fourth sidewall. A first inner supporting plate arranged on the first sidewall has a first vertical side edge sewn on the first sidewall, and a second vertical side edge of the first inner supporting plate is movable relative to the first sidewall. A second inner supporting plate arranged on the second sidewall has a third vertical side edge sewn on the second sidewall, and a fourth vertical side edge of the second inner supporting plate is movable relative to the second sidewall.

As a further improvement, a bottom side of the lower-layer bag body includes a waterproof canvas and a supporting bottom plate from bottom to top. A side edge of the supporting bottom plate is sewn at a bottom portion of the third sidewall, and a folding line is arranged in a middle of the supporting bottom plate.

As a further improvement, the first sidewall and the second sidewall each have an easy-to-fold mark at a center position, the easy-to-fold mark enables the first sidewall and the second sidewall to be folded inwards.

As a further improvement, the connecting portions are each connected between two adjacent protruding portions.

As a further improvement, each connecting portion includes an engaging groove and an engaging head, and the engaging head is fitted and engaged with the engaging groove.

As a further improvement, the upper-layer bag body includes an interlayer, an upper surface of the interlayer is provided with a first storage pocket and a first insertion pocket, and first elastic fasteners are arranged above the first insertion pocket.

As a further improvement, above the lower-layer bag body, a second insertion pocket is arranged on a lower surface of the interlayer, the second insertion pocket has a cover, and a second storage pocket is arranged beside the second insertion pocket.

As a further improvement, a height of the upper-layer bag body is h1, a height of the lower-layer bag body is h2, then h1 is ⅕-½ times of h2.

The present disclosure has the following advantages.

1. The cosmetic bag main body of the present disclosure is provided with a plurality of inner supporting plates and a plurality of partition plates. The inner supporting plates are arranged on the inner sidewalls of the cosmetic bag main body. Each partition plate is formed by sequentially connecting a plurality of protruding portions and a plurality of connecting portions. A size of the connecting portions is slightly smaller than a size of the protruding portions, so as to form a plurality of strip grooves on two sides of each partition plate. Two ends of each partition plate are connecting portions to enable the partition plates to be connected with the supporting grooves on the inner supporting plate and/or the strip grooves on two sides of other partition plates. By arranging the inner supporting plates and the partition plates, the inner space of the cosmetic bag main body can be freely changed and combined according to the user's requirements. The free variations of the partition of the internal space in of the cosmetic bag main body is convenient for storing and protecting various cosmetic products, which is multi-functional and widely applicable.

2. The cosmetic bag main body of the present disclosure includes an upper-layer bag body and a lower-layer bag body, wherein the heights of the upper-layer bag body and the lower-layer bag body are different. The height of the lower-layer bag body is greater than that of the upper-layer bag body, and the lower-layer bag body has a larger space. The double-layered cosmetic bag can improve the functions and increasing the capacity for storing more cosmetic products.

3. The inner supporting plates arranged on the first and second sidewalls each includes a vertical side edge sewn on the corresponding sidewall, and another vertical side edge of the inner supporting plates is movable relative to the sidewall. A bottom side of the lower-layer bag body includes a waterproof canvas and a supporting bottom plate from bottom to top. A side edge of the supporting bottom plate is sewn at a bottom portion of the third sidewall, and a folding line is arranged in a middle of the supporting bottom plate to enable the supporting bottom plate to be folded up. The first sidewall and the second sidewall each have an easy-to-fold mark at a center position, the easy-to-fold mark enables the first sidewall and the second sidewall to be folded inwards, so that the lower-layer bag body can be folded up. By this arrangement, the cosmetic bag is foldable, portable, and multi-functional. Further, the cosmetic bag of the present disclosure is compact and multi-functional, which can not only meet the demands of the general user, but also professional makeup artists.

BRIEF DESCRIPTION OF THE DRAWINGS

In order to illustrate the technical solutions used in the implementations of the present disclosure clearly, the drawings that are related to the illustration of the implementations will be briefly introduced below. It should be understood that the following drawings only show parts of the embodiments of the present disclosure. Therefore, the drawings should not be regarded as a limit to the scope of the present disclosure. For those of ordinary skill in the art, other related drawings can be derived from these drawings without creative effort.

Figure 1:
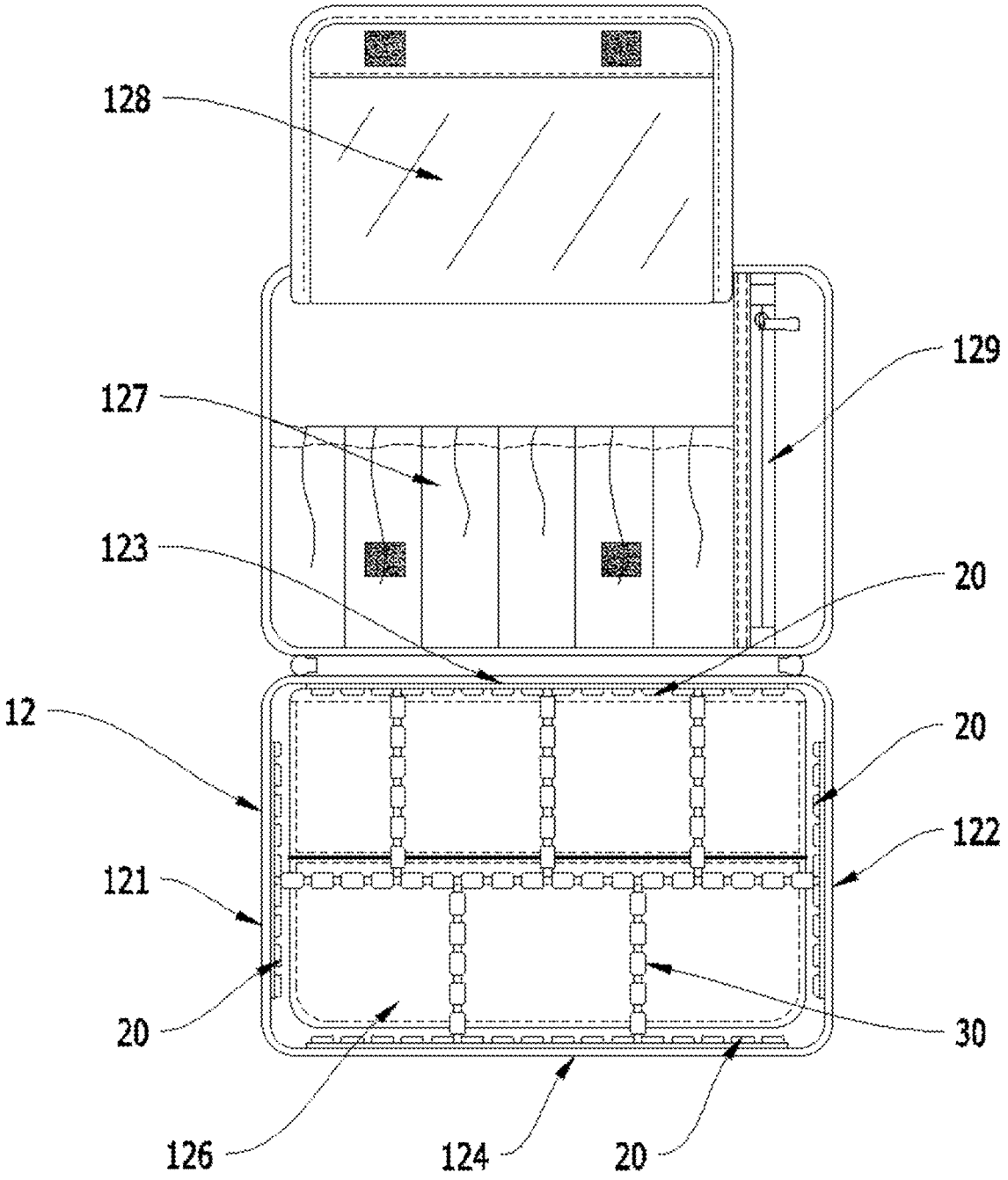
FIG. 1 is a schematic diagram showing an internal structure of a lower-layer bag body of a detachable cosmetic bag according to embodiment 1 of the present disclosure.

The reference numbers in the drawings are listed below.

10. cosmetic bag main body;

11. upper-layer bag body; 111. first storage pocket; 112. first insertion pocket; 113. first elastic fastener; 114. second elastic fastener;

12. lower-layer bag body; 121. first sidewall; 122. second sidewall; 123. third sidewall; 124. fourth sidewall; 125. waterproof canvas; 126. supporting bottom plate; 1261. folding line; 127. second pocket; 128. insertion pocket cover; 129. second storage pocket; 1200. easy-to-fold mark;

20. inner supporting plate; 21. supporting groove;

30. partition plate; 31. connecting portion; 311. engaging groove; 312. engaging head; 32. protruding portion.

DETAILED DESCRIPTION OF THE DISCLOSURE

In order to make the objectives, technical solutions, and advantages of the embodiments of the present disclosure clearer, the technical solutions of the embodiments of the present disclosure will be described clearly and completely below with reference to the drawings of the embodiments of the present disclosure. Obviously, the described embodiments are parts of, but not all of, the embodiments of the present disclosure. Based on the embodiments of the present disclosure, all other embodiments derived by those of ordinary skills in the art without creative effort fall within the scope of protection of the present disclosure. Accordingly, the following detailed description of the embodiments of the present disclosure shown in the drawings is not intended to limit the scope of protection of the present disclosure, but merely to represent selected embodiments of the present disclosure.

In the description of the present disclosure, the terms "first", "second" are used only for descriptive purposes and cannot be understood as indicating or implying relative importance or implying the number of indicated technical features. Thus, a feature that is referred to by "first" and "second" may include, expressly or implicitly, one or more of the features. Also, in the description of the present disclosure, the phrase "a plurality of" means two or more, unless otherwise specified.

Embodiment 1

Figure 2:
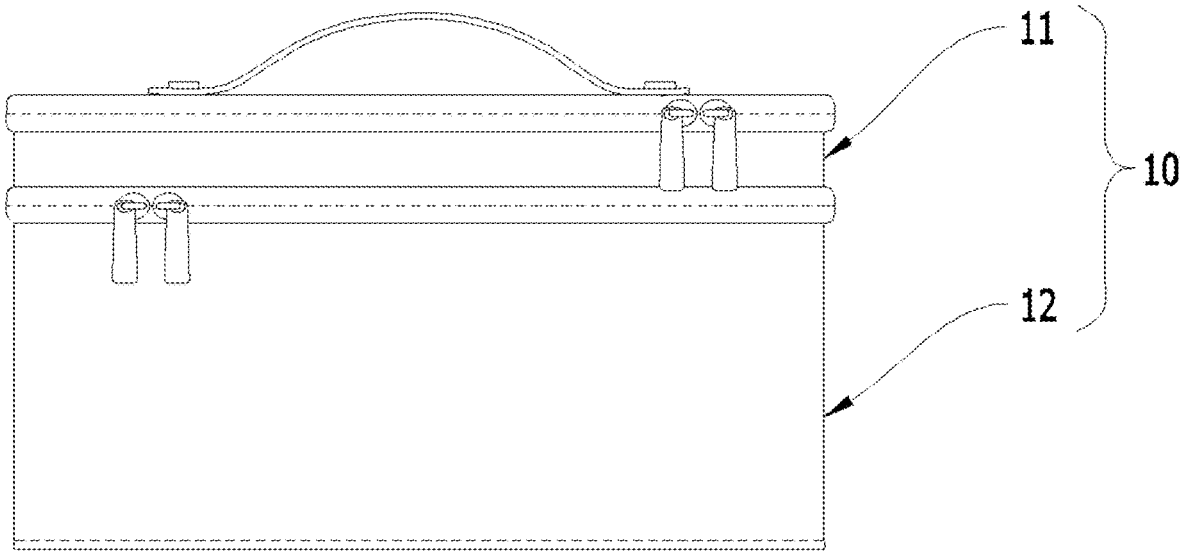
FIG. 2 is a front view of a detachable cosmetic bag according to embodiment 1 of the present disclosure.

Referring to FIGS. 1-2, embodiment 1 of the present disclosure provides a detachable cosmetic bag, including:

a cosmetic bag main body 10, wherein the cosmetic bag main body 10 includes an upper-layer bag body 11 and a lower-layer bag body 12, inner supporting plates 20, and partition plates 30 are arranged inside the lower-layer bag body 12.

Figure 5:
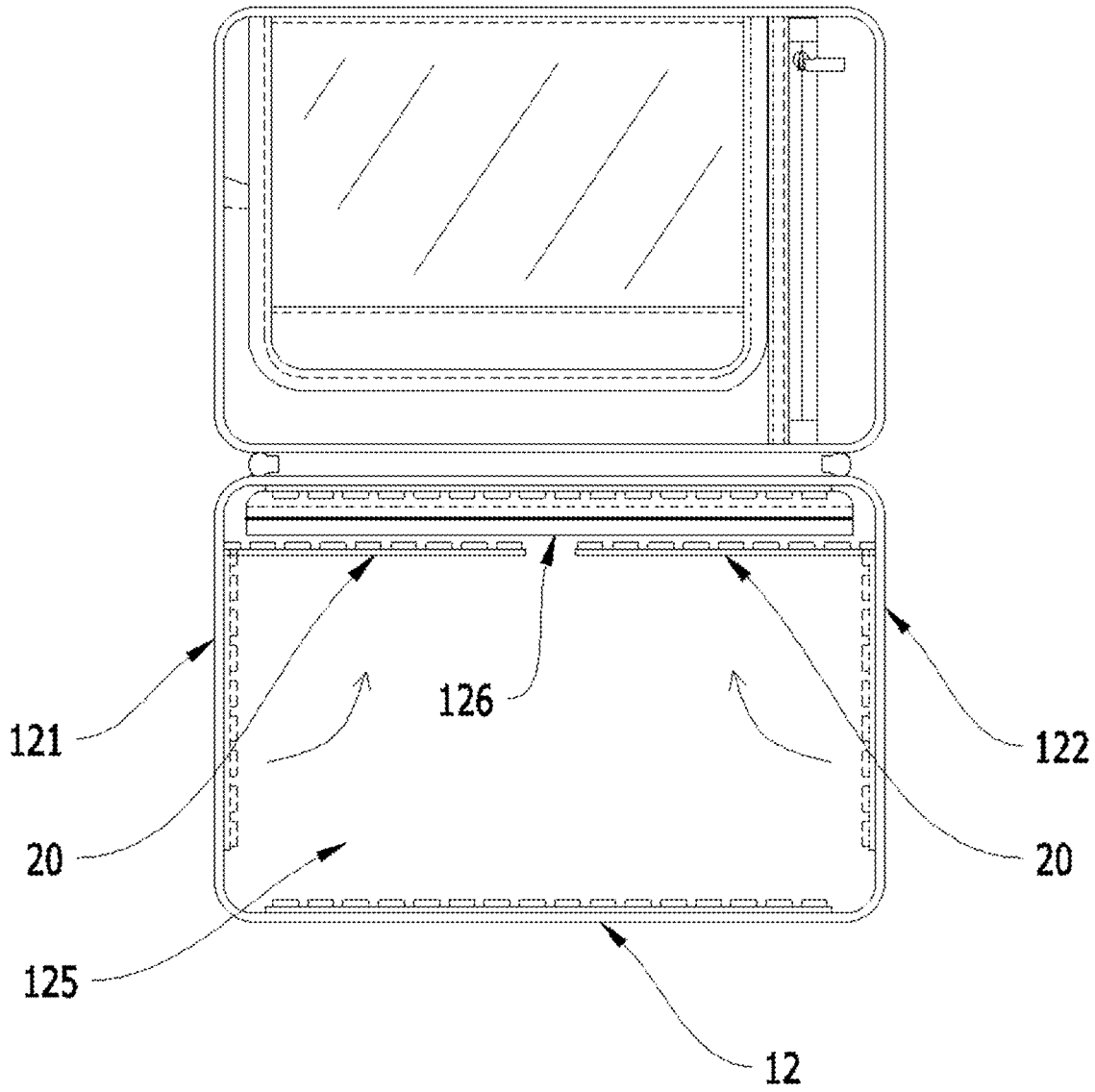
FIG. 5 is a structural schematic diagram showing the lower-layer bag body of the detachable cosmetic bag with the inner supporting plates rotated to an inner side according to embodiment 1 of the present disclosure.

The lower-layer bag body 12 includes four sidewalls, i.e. a first sidewall 121, a second sidewall 122, a third sidewall 123, and a fourth sidewall 124. The inner supporting plates 20 are respectively arranged on the inner surface of the four sidewalls. Specifically, in the present embodiment, four inner supporting plates 20 are respectively arranged on the inner surfaces of the first sidewall 121, the second sidewall 122, the third sidewall 123, and the fourth sidewall 124. The inner supporting plates 20 arranged on the third sidewall 123 and the fourth sidewall 124 are fixedly connected with the third sidewall 123 and the fourth sidewall 124, and the inner supporting plates 20 arranged on the first sidewall 121 and the second sidewall 122 are movably connected with the first sidewall 121 and the second sidewall 122. In the present embodiment, the movable connection is realized by sewing a vertical side edge of the inner supporting plate 20 arranged on the first sidewall 121 to the first sidewall 121, another vertical side edge of the inner supporting plate 20 is movable and can rotate around the fixed vertical side edge. Similarly, the inner supporting plate 20 arranged on the second sidewall 122 can also be arranged in the same manner. Any one of the two vertical side edges of the inner supporting plate 20 arranged on the first sidewall 121 (or the second sidewall 122) can be sewn and fixed to the first sidewall 121 (or the second sidewall 122), so that the inner supporting plate 20 can rotate around the fixed edge to a position adjacent to and parallel to the third sidewall 123 or the fourth sidewall 124, as shown in FIG. 5.

Further, in the present embodiment, when the cosmetic bag is in an unfolded state, one side surface of each inner supporting plate 20 is attached to the inner surface of the lower-layer bag body 12, and another side surface of each inner supporting plate 20 faces toward the accommodating space of the lower-layer bag body 12 and is uniformly provided with a plurality of supporting grooves 21. The opening the supporting grooves 21 faces toward the accommodating space of the lower-layer bag body 12. In the present embodiment, the main body of the inner supporting plate 20 is an elastic plate-shaped structure with protrusions and grooves on one side surface, and particularly the inner supporting plate can be a plastic plate. Two side surfaces of the plate-shaped structure are both bonded with a layer of fabric with a soft nap or pile on one or either side, so that the supporting groove 21 has a friction resistance when engaged with the end portion of the partition plate 30, and the connection stability of the supporting groove 21 and the connecting portion 31 is improved.

Figure 8:
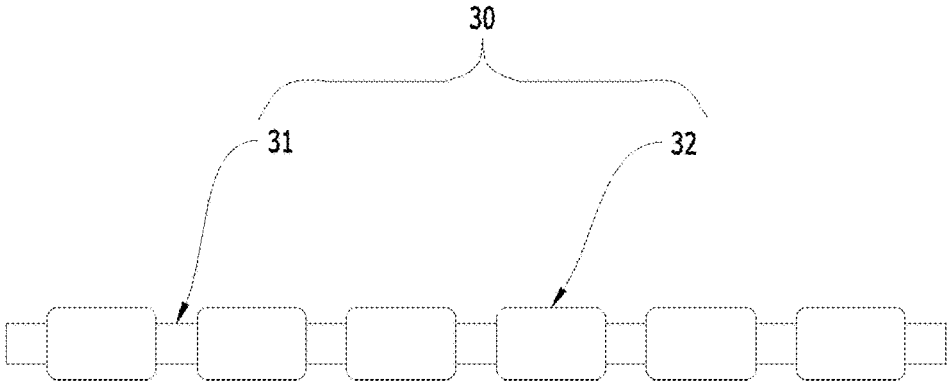
FIG. 8 is a structural schematic diagram of a partition plate according to embodiment 1 of the present disclosure.

Further, as shown in FIGS. 1 and 8, the lower-layer bag body 12 is also provided with a detachable movable partition plate 30, and the partition plate 30 is formed by connecting a plurality of protruding portions 32 and connecting portions 31. The length and the width of the protruding portion 32 are greater than the length and the width of the connecting portion 31 so as to form a plurality of strip grooves on the two sides of the partition plate. Two ends of each partition plate 30 are connecting portions 31 so as to fit with the supporting grooves 21 on the inner supporting plate 20 and/or the strip groove on two sides of other partition plates 30.

Specifically, the protruding portions 32 and the connecting portions 31 in the present embodiment are sequentially and fixedly connected. The protruding portions 32 and the connecting portions 31 can be sequentially connected to form the partition plate 30 of different lengths, the two outermost ends of each partition plate 30 are connecting portions 31 for being connected to the supporting grooves 21 and/or the strip grooves on two sides of other partition plates 30. Hence, in the present embodiment, each partition plate 30 is detachably connected, and the length of the partition plate 30 can be changed as desired to partition the accommodating space of the lower-layer bag body 12 into a plurality of blocks of any sizes. The supporting grooves and the strip grooves on two sides of the partition plate 30 have identical widths, so that the connecting portion 31 can either be inserted into the supporting groove 21 or the strip grooves on two sides of the partition plate 30. In the present embodiment, the main body of the protruding portions 32 and the connecting portions 31 are made of an elastic strip-shaped material with a rectangular-like cross section. Specifically, the material may be plastic. A layer of fabric with a soft nap or pile on one or either side is bonded to the surface of the strip-shaped material, so that the connecting portion 31 has frictional resistance when the connecting portion 31 is inserted into the supporting grooves or the strip grooves on the two sides of other partition plates 30.

Figure 4:
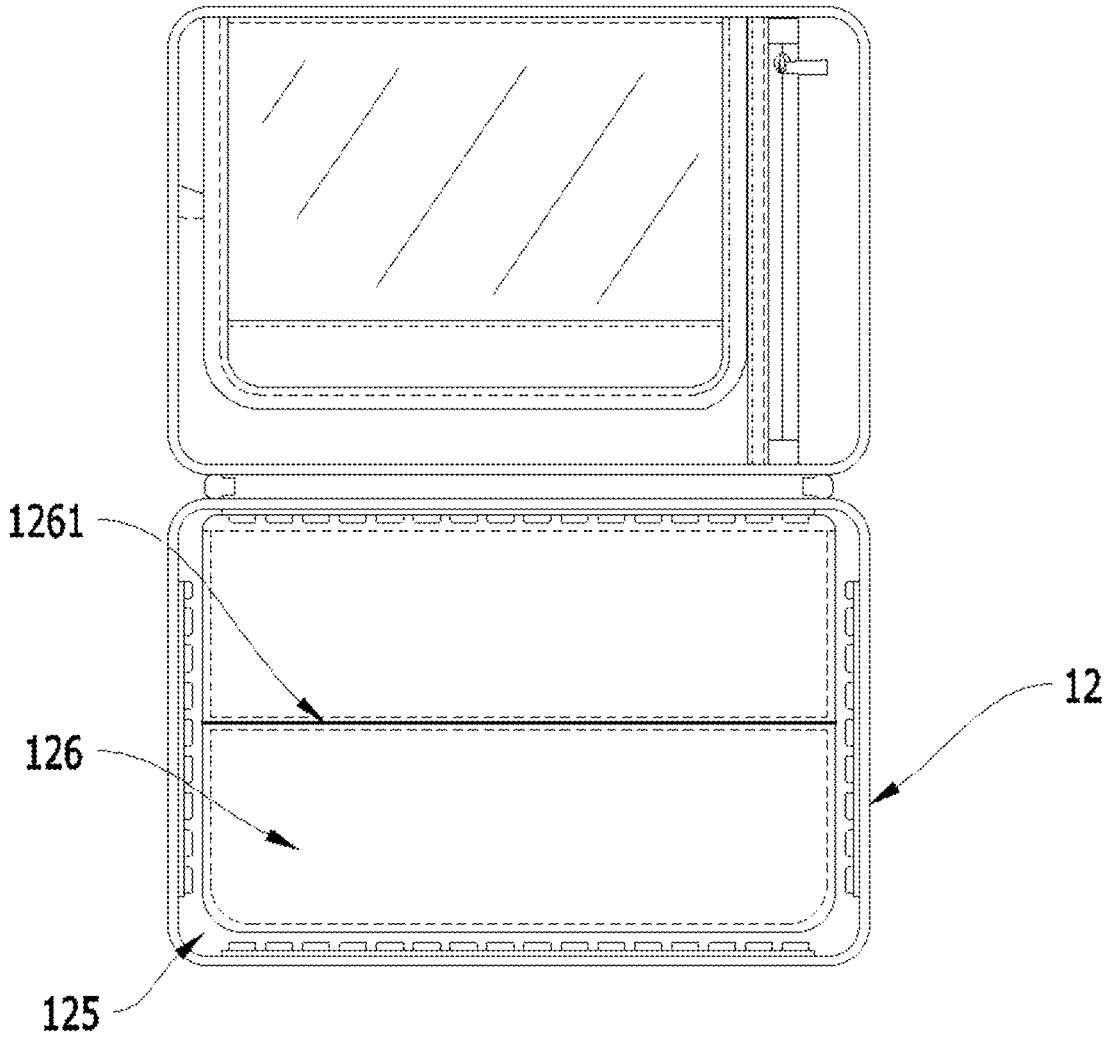
FIG. 4 is a structural schematic diagram showing the lower-layer bag body of the detachable cosmetic bag with partition plates removed according to embodiment 1 of the present disclosure.

Further, as shown in FIG. 4 and FIG. 5, the bottom side of the lower-layer bag body 12 includes a waterproof canvas 125 and a supporting bottom plate 126 from bottom to top. A side edge of the supporting bottom plate 126 is sewn at the bottom portion of the third sidewall 123. A folding line 1261 is arranged in the middle of the supporting bottom plate 126 so that the supporting bottom plate 126 can be folded towards the third sidewall 123.

Specifically, in the present embodiment, the bottom of the lower-layer bag body 12 has a two-layer structure including a waterproof canvas 125 and a supporting bottom plate 126 from bottom to top. The outer layer of the supporting bottom plate 126 is the waterproof canvas, the inner layer of the supporting bottom plate is composed of two plastic plates which are arranged side by side and can be folded up. The waterproof canvas between the two plastic plates is sewn to form a folding line 1261. The two plastic plates can be folded up along the folding line 1261, so that the supporting bottom plate 126 can be folded up and attached to the surface of the third sidewall 123. After the supporting bottom plate 126 is folded up, the lower-layer bag body 2 can be folded up conveniently.

Figure 6:
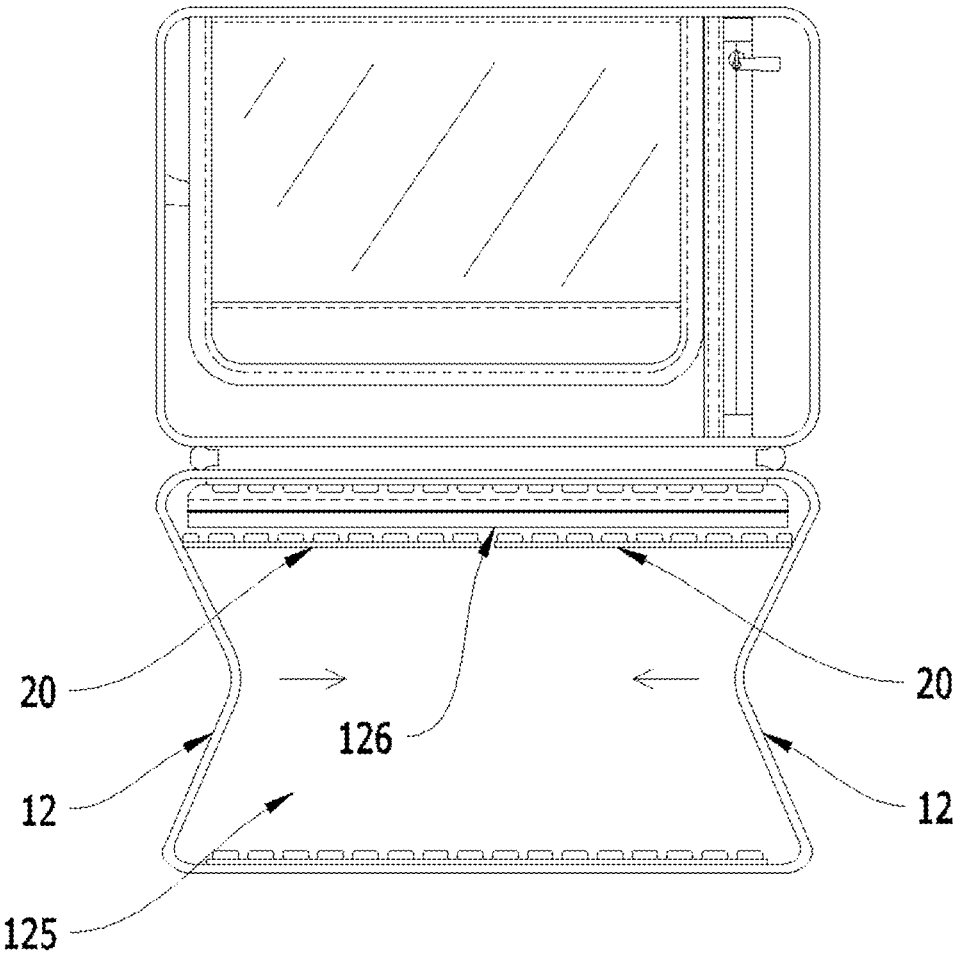
FIG. 6 is a schematic diagram showing a folding process of a lower-layer bag body of a detachable cosmetic bag according to embodiment 1 of the present disclosure.
Figure 7:
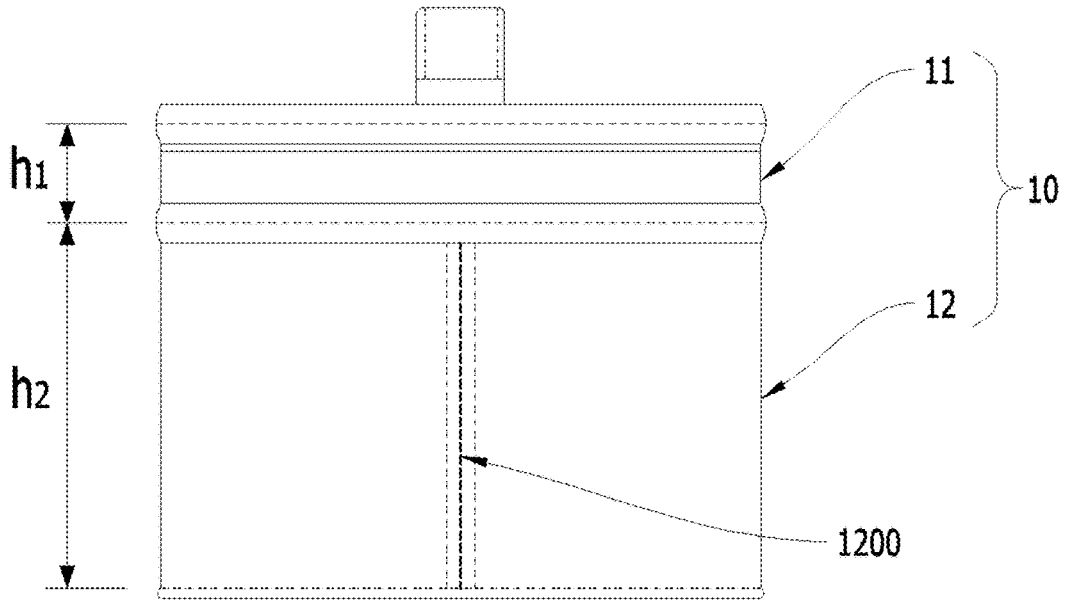
FIG. 7 is a left view based on FIG. 2 according to embodiment 1 of the present disclosure.

Further, as shown in FIG. 6 and FIG. 7, the first sidewall 121 and the second sidewall 122 each have an easy-to-fold mark 1200 at a center position, the easy-to-fold mark enables the first sidewall 121 and the second sidewall 122 to be folded inwards.

Specifically, after the supporting bottom plate 126 is folded up, the first sidewall 121 and the second sidewall 122 are pressed inward in a direction vertical to the sidewall, then the first sidewall 121 and the second sidewall 122 are deformed inwards. Since the waterproof canvas 125 at the bottom of the lower-layer bag body 12 is a soft single-layer fabric that deforms easily, the fourth sidewall 14 moves gradually toward the third sidewall, so that the lower-layer bag body 12 is folded up into a structure with a smaller volume.

Figure 3:
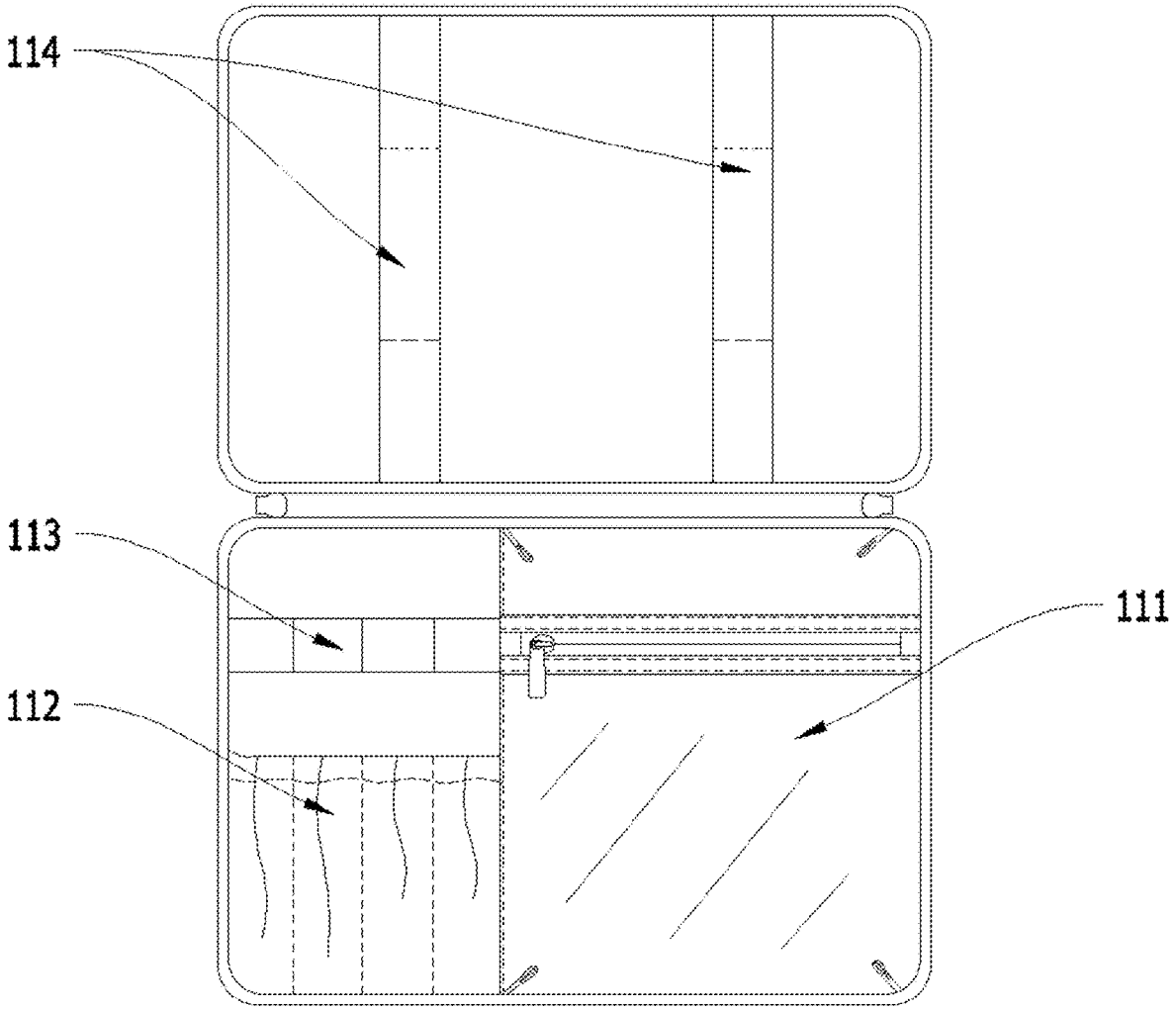
FIG. 3 is a schematic diagram showing an internal structure of an upper-layer bag body of the detachable cosmetic bag according to embodiment 1 of the present disclosure.

Further, as shown in FIG. 3, the upper-layer bag body 11 includes an interlayer, the upper surface of the interlayer is provided with a first storage pocket 111 and a first insertion pocket 112. First elastic fasteners 113 are arranged above the first insertion pocket 112. An outer layer of the first storage pocket 111 is made of transparent plastic to provide a waterproof performance and make it easy to check the items in the first storage pocket 111. Meanwhile, an inner surface of the upper cover of the cosmetic bag main body 10, namely, the surface at the upper portion of the upper-layer bag body 11 is provided with second elastic fasteners 114 on the left side and the right side to increase the functions of the cosmetic bag, so that the bag can hold more items with smaller size.

Further, above the lower-layer bag body, the lower surface of the interlayer is provided with a second insertion pocket 127, the second insertion pocket 127 is provided with a transparent pocket cover 128, and a second storage pocket 129 is arranged beside the second insertion pocket 127.

The end of the pocket cover 128 is provided with a hook-and-loop fastener or buckle for closing the second insertion pocket 127. The material of the pocket cover 128 is a transparent plastic film which makes it easy to check the cosmetic products placed in the second insertion pocket 127 while providing the protection function, so that the residue of the makeup pen in the second insertion pocket 127 can be prevented from falling into the cosmetic bag. The second storage pocket 129 is located between the second insertion pocket 127 and the interlayer, and a zipper is arranged on the right side of the second insertion pocket 127 for opening the second storage pocket 129.

Further, a height of the upper-layer bag body 11 is defined as h1, a height of the lower-layer bag body 12 is defined as h2, and h1 is ⅕-½ times of h2.

As shown in FIG. 7, the upper-layer bag body 11 is mainly used for placing items like makeup pens and so on, which has a strip or thin shape. The lower-layer bag body 12 is used for placing a bottled or canned cosmetic product, and the partition plates 30 inside the lower-layer bag body 11 can separate the space freely to form a plurality of spaces. The user can make modifications as desired. Therefore, the height h2 of the lower-layer bag body 12 should be larger than the height h1 of the upper-layer bag body 11. Optionally, h1 is ⅓ times of h2. When the lower-layer bag body 12 is folded up, the upper-layer bag body 11 can be directly stacked on the lower-layer bag body 12, so that the cosmetic bag main body 10 is easy to be stored and carried.

Embodiment 2

Figure 9:
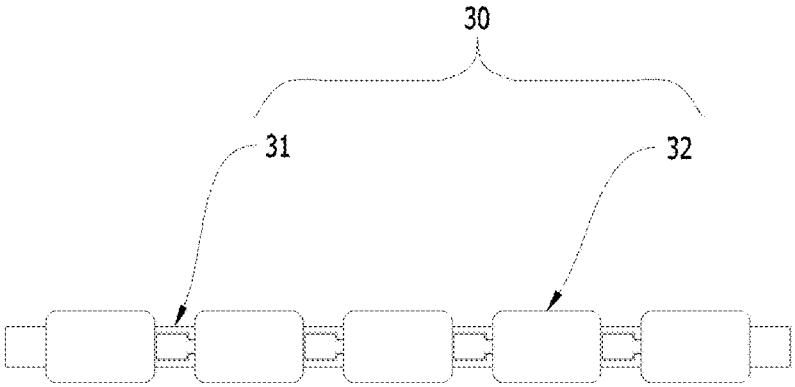
FIG. 9 is a schematic diagram showing the connection of the partition plate according to embodiment 2 of the present disclosure.
Figure 10:
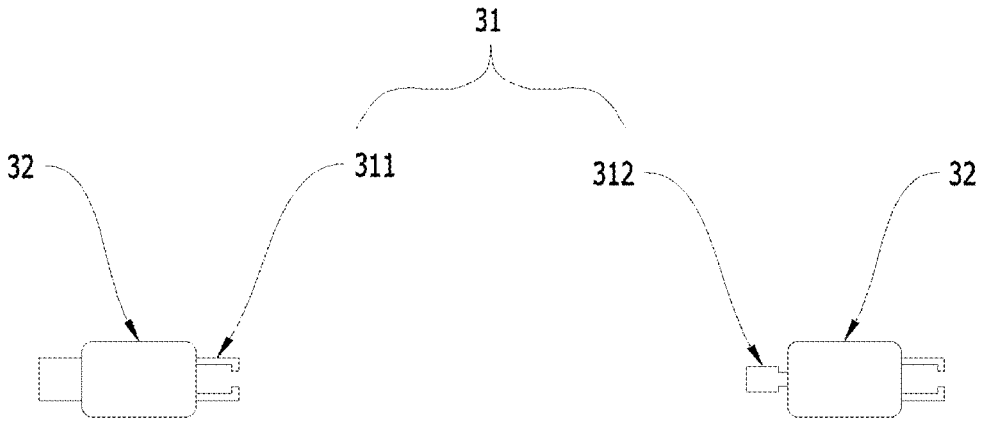
FIG. 10 is a schematic diagram showing a disassembled state of the partition plate according to embodiment 2 of the present disclosure.

As shown in FIG. 9 and FIG. 10, the connecting portion 32 includes an engaging groove 311 and an engaging head 312. The engaging head 312 has a first part and a second part, the first part is larger than the second part. The engaging groove 311 can be connected or disconnected with the engaging head 312. The engaging groove 311 and the engaging head 312 are respectively fixed on the face-to-face end surfaces of two protruding portions 31.

In the present embodiment, the main body of the protruding portions 32 and the connecting portions 31 are both made of an elastic strip-shaped material with a rectangular-like cross section. The material may be plastic. A layer of fabric with a soft nap or pile on one or either side is bonded to the surface of the strip-shaped material. When the engaging groove 311 is engaged with the engaging head 312, the frictional resistance between the fabrics can improve the connection stability between the engaging groove 311 and the engaging head 312. At the same time, the hook at the end of the engaging groove 311 can be hooked on a recessed portion on the engaging head 312, so that the engaging groove 311 and the engaging head 312 are steadily connected. According to the present embodiment, the connecting portion 31 includes an engaging groove 311 and an engaging head 312 which are detachable, so that the user can freely adjust the length of the partition plate 30 as desired. Hence, there are many ways of separating the space, and the user experience is improved.

Embodiment 3

Figure 11:
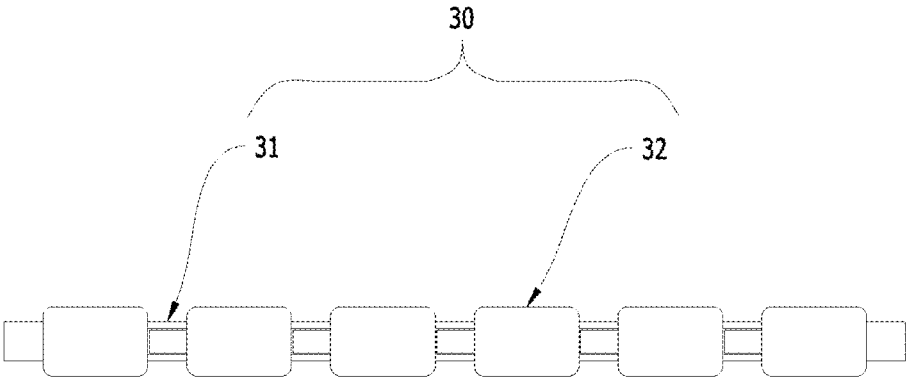
FIG. 11 is a schematic diagram showing the connection of the partition plate according to embodiment 3 of the present disclosure.
Figure 12:
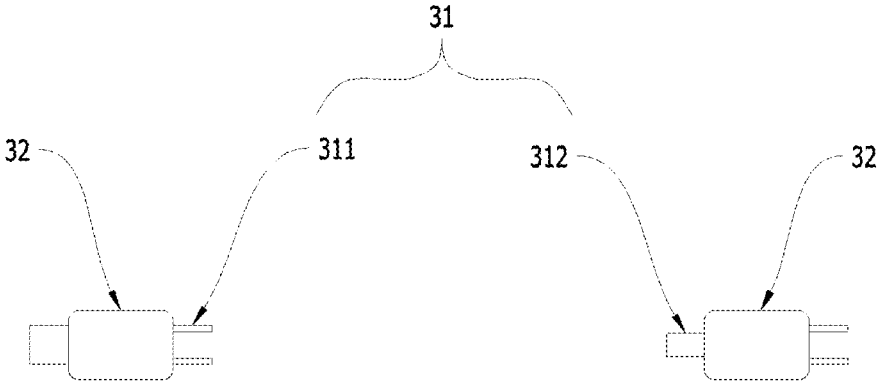
FIG. 12 is a schematic diagram showing a disassembled state of the partition plate according to embodiment 3 of the present disclosure.

As shown in FIG. 11 and FIG. 12, the connecting portion 31 includes an engaging groove 311 and an engaging head 312. The engaging groove 311 is formed by two parallel plates. The engaging head 312 has a columnar shape and is directly inserted into the engaging groove 311 from the front end.

Similar to embodiment 2, the main body of the protruding portions 31 and the connecting portions 31 are both made of an elastic strip-shaped material with a rectangular-like cross section. The material may be plastic. A layer of fabric with a soft nap or pile on one or either side is bonded to the surface of the strip-shaped material. When the engaging groove 311 is engaged with the engaging head 312, the frictional resistance between the fabrics can improve the connection stability between the engaging groove 311 and the engaging head 312. At the same time, in the present embodiment, the engaging head 312 can be directly inserted into the engaging groove 312 from the front end, which is convenient, quick and easy to operate, and easy to use. There is frictional resistance between the engaging head 312 and the engaging groove 311, so it is not easy to separate. Also, when the partition plates 30 assembled by the protruding portions 32 and the connecting portions 31 supports the separation of space of the lower-layer bag body 12, the engaging grooves 311 and the engaging heads 312 of each partition plate 30 press against each other, so the connection stability of the partition plate 30 can be improved. Similar to embodiment 2, in the present embodiment, the connecting portion 31 includes an engaging groove 311 and an engaging head 312 which are detachable, so the user can freely adjust the length of the partition plate 30, thereby providing the user with more choices of separating the space and improving the user's experience.

Embodiment 4

Compared with embodiment 1, embodiment 4 provides an alternative solution for folding the lower-layer bag body 12. Specifically, the first sidewall 121 and the second sidewall 122 are fordable as a folding line is respectively provided at the vertical center position of the first sidewall 121 and the second sidewall 122. The inner supporting plates 20 provided on the first sidewall 121 and the second sidewall 122 are made of fordable material, such as soft fabric etc., so the inner supporting plates 20 can be folded together with the first sidewall 121 and the second sidewall 122.

Embodiment 5

Figure 13:
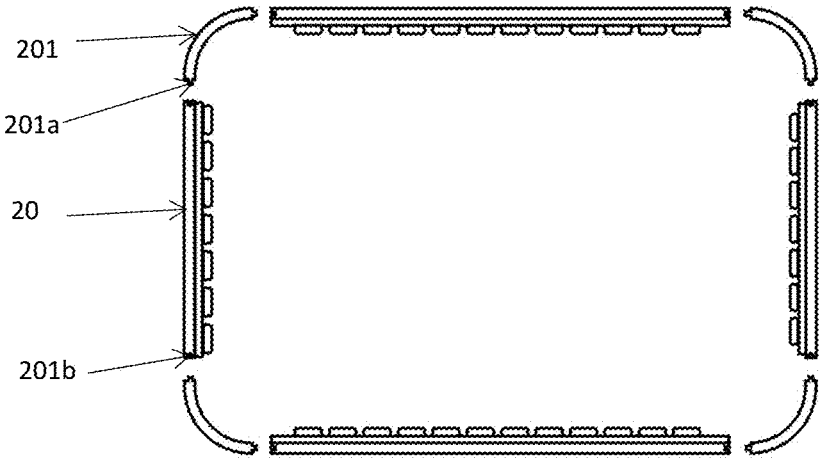
FIG. 13 is a schematic diagram showing a detachable supporting frame according to embodiment 5 of the present disclosure.
Figure 14:
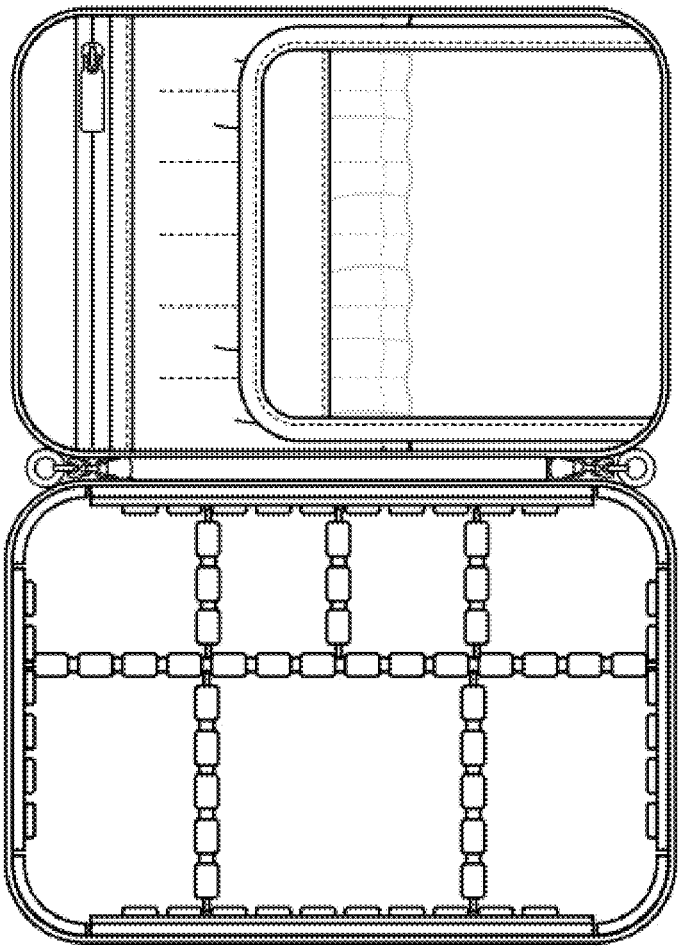
FIG. 14 is a schematic diagram showing the detachable supporting frame placed inside the lower-layer bag body according to embodiment 5 of the present disclosure.

Compared with embodiment 1, embodiment 4 provides an alternative solution for folding the lower-layer bag body 12. Specifically, as shown in FIGS. 13-14, the inner sporting plates 20 are no longer attached on the sidewalls of the lower-layer bag body 12. Rather, four connectors 201 are further provided at four corners to connect four inner sporting plates 20 at four sides. The connectors 201 are arc-shaped and have male connecting joints 201*a* at its side edges. While, the side edges of the four inner supporting plates are correspondingly provided with female connecting joints 201*b* matched with the male connecting joints 201*a*. Further, the connection between the female connecting joints 201*b* and the male connecting joints 201*a* are detachable. For example, the male connecting joint 201*a* is a protrusion at the side edge of the connector 201, and the female connecting joint 201*b* is a groove at the side edge of the inner supporting plate 20. In use, the inner supporting plates 20 and the connectors 201 are assembled to form a supporting frame, then the supporting frame is placed inside the lower-layer bag body 12. When the user wants to fold up the cosmetic bag, the supporting frame is taken out of the lower-layer bag body 12, so the lower-layer bag body 12 can be folded up freely as it is made of fordable fabric. Then, the supporting frame can be disassembled for storage.

Optionally, the inner supporting plates 20 also can be directly connected to form a supporting frame without detachable corner connectors. Then, the vertical center position of inner supporting plates on the left and right sides is provided with a folding line to fold the supporting frame. In use, the supporting frame is placed inside the lower-layer bag body 12 to support the sidewalls. When the user wants to fold up the cosmetic bag, the supporting frame is taken out of the lower-layer bag body 12 and is folded up from the folding lines on the the vertical center position of inner supporting plates on the left and right sides. Then, the the lower-layer bag body 12 can also be folded up freely as it is made of fordable fabric.

Embodiment 6

Figure 15:
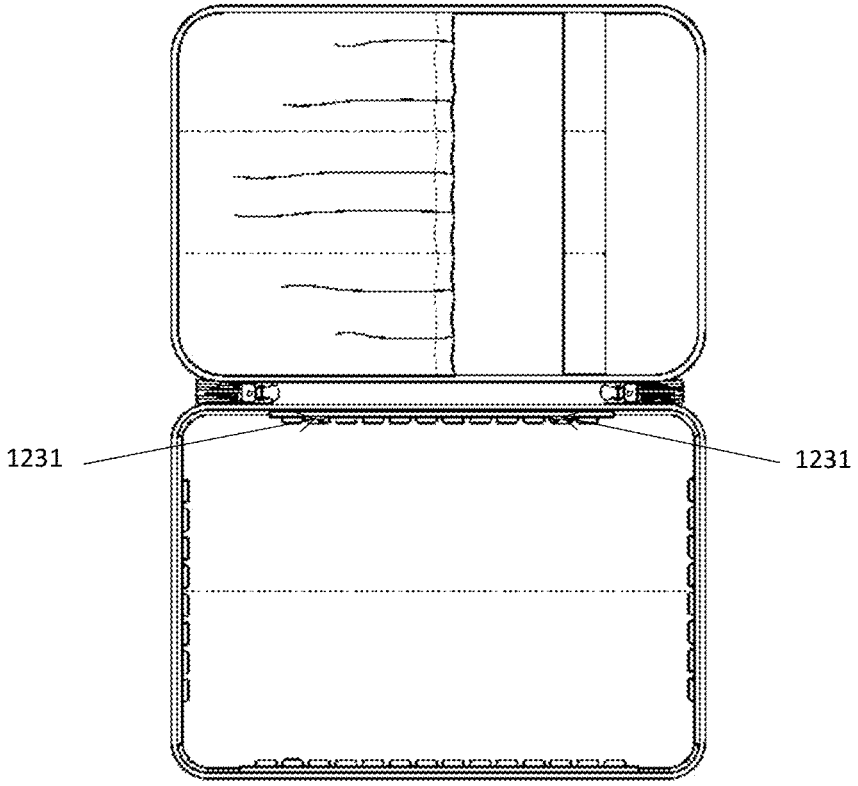
FIG. 15 is a schematic diagram showing a cosmetic bag according to embodiment 6 of the present disclosure.
Figure 16:
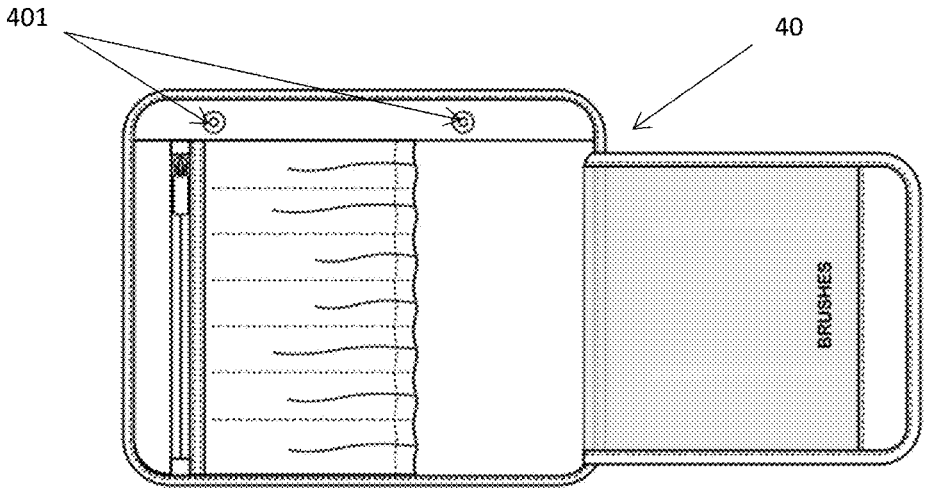
FIG. 16 is a schematic diagram showing a carry-on bag according to embodiment 6 of the present disclosure.

As shown in FIGS. 15-16, compared with embodiment 1, embodiment 6 further provides two buttons 1231 on the upper side of the third sidewall 123. A carry-on bag 40 with two connectors 401 matched with the buttons 1231 can be connected to the lower-layer bag body 12 through the buttons 1231. In use, user can easily detach the carry-on bag 40 from the buttons 1231. The buttons 1231 may be snap button, press button, and so on.

The above description merely includes is merely the preferred embodiments of the present disclosure which is not intended to limit the scope of the present disclosure. For those skilled in the art, the present disclosure may be practiced with various modifications and variations. Any modifications, equivalent substitution, improvements, etc., made within the spirit and principles of the present disclosure are intended to be included within the scope of the present disclosure.

What is claimed is:

1. A detachable cosmetic bag, comprising:

a cosmetic bag main body;

a plurality of inner supporting plates, wherein the inner supporting plates are respectively arranged on inner sidewalls of the cosmetic bag main body, and a side surface of each inner supporting plate is provided with supporting grooves arranged uniformly; and a plurality of partition plates, wherein each partition plate is formed by sequentially connecting a plurality of connecting portions and a plurality of protruding portions, a size of each connecting portion is smaller than a size of each protruding portion to form a plurality of strip grooves on two sides of each partition plate, two ends of each partition plate are connecting portions to enable the partition plate to be connected with the supporting grooves on the inner supporting plates and/or the strip grooves on two sides of other partition plates;

the cosmetic bag main body comprises an upper-layer bag body and a lower-layer bag body; the inner supporting plates and the partition plates are both arranged inside the lower-layer bag body;

the lower-layer bag body comprises a first sidewall, a second sidewall, a third sidewall, and a fourth sidewall, wherein a first inner supporting plate arranged on the first sidewall has a first vertical side edge sewn on the first sidewall, and a second vertical side edge of the first inner supporting plate is movable relative to the first sidewall, a second inner supporting plate arranged on the second sidewall has a third vertical side edge sewn on the second sidewall, and a fourth vertical side edge of the second inner supporting plate is movable relative to the second sidewall.

2. The detachable cosmetic bag according to claim 1, wherein a bottom side of the lower-layer bag body comprises a waterproof canvas and a supporting bottom plate from bottom to top, a side edge of the supporting bottom plate is sewn at a bottom portion of the third sidewall, and a folding line is arranged in a middle of the supporting bottom plate.

3. The detachable cosmetic bag according to claim 1, wherein the first sidewall and the second sidewall each have an easy-to-fold mark at a center position, the easy-to-fold mark enables the first sidewall and the second sidewall to be folded inwards.

4. The detachable cosmetic bag according to claim 1, wherein the connecting portions are each connected between two adjacent protruding portions.

5. The detachable cosmetic bag according to claim 1, wherein each connecting portion comprises an engaging groove and an engaging head, and the engaging head is fitted and engaged with the engaging groove.

6. The detachable cosmetic bag according to claim 1, wherein the upper-layer bag body comprises an interlayer, an upper surface of the interlayer is provided with a first storage pocket and a first insertion pocket, and first elastic fasteners are arranged above the first insertion pocket.

7. The detachable cosmetic bag according to claim 1, wherein the upper-layer bag body comprises an interlayer, above the lower-layer bag body, a second insertion pocket is arranged on a lower surface of the interlayer, the second insertion pocket has a cover, and a second storage pocket is arranged beside the second insertion pocket.

8. The detachable cosmetic bag according to claim 1, wherein a height of the upper-layer bag body is h1, a height of the lower-layer bag body is h2, and h1 is ⅕-½ times of h2.

* * * * *